United States Patent [19]

Wixon

[11] 4,257,908

[45] Mar. 24, 1981

[54] LAUNDRY DETERGENT IN GEL FORM

[75] Inventor: Harold E. Wixon, New Brunswick, N.J.

[73] Assignee: Colgate Palmolive Company, New York, N.Y.

[21] Appl. No.: 788,475

[22] Filed: Apr. 18, 1977

Related U.S. Application Data

[63] Continuation of Ser. No. 603,599, Aug. 11, 1975, abandoned.

[51] Int. Cl.[3] ..... C11D 3/065

[52] U.S. Cl. ..... 252/135; 8/137; 252/531; 252/532

[58] Field of Search ..... 252/135, 531, 532, 89 R; 8/137

[56] References Cited

U.S. PATENT DOCUMENTS

| | | | |
|---|---|---|---|
| 3,776,851 | 12/1973 | Cheng | 252/532 X |
| 3,923,678 | 12/1975 | Kleiner et al. | 252/135 X |

*Primary Examiner*—Thomas J. Herbert, Jr.
*Attorney, Agent, or Firm*—Norman Blumenkopf; Herbert S. Sylvester; Murray M. Grill

[57] ABSTRACT

A highly concentrated detergent composition in the form of a stable, single phase gel comprising by weight (A) from about 5 to 40 parts of a sulfated, polyoxy alkylenated $C_{10}$–$C_{22}$ alcohol containing from about 1 to 6 moles of combined alkylene oxide, the ratio of the number of carbon atoms in the said alcohol to the number of moles of combined alkylene oxide being from about 2:1 to 5:1, (B) from about 25 to 55 parts of alkali metal pyrophosphate and (C) from about 30 to 50 parts of solvent medium comprising water and water miscible, alcoholic solvent, the total of parts (A), (B) and (C) being 100 parts.

11 Claims, No Drawings

LAUNDRY DETERGENT IN GEL FORM

This is a continuation of application Ser. No. 603,599 filed Aug. 11, 1975 now abandoned.

BACKGROUND OF THE INVENTION

1. Field of the Invention

The invention relates in general to laundry detergent compositions and in particular to such compositions in the form of a translucent, stable, viscous, single phase gel readily dispensible in aqueous media over a wide temperature range.

2. Description of the Prior Art

Liquid laundry detergents heretofore provided and containing appreciable amounts of phosphate builder invariably require significant amounts of coupling or emulsifying agents to produce stable, single phase systems. For example, it is the usual practice to utilize hydrotropes such as lower alkyl aryl sulfonates e.g., sodium toluene sulfonate and the like with anionic type detergents, while resinous polymers such as polyvinyl methyl ether-maleic anhydride (PVM/MA) are similarly used with nonionic type detergents. Even with the use of such stabilizing agents, the amount of phosphate builder tolerated by the detergent composition is nevertheless limited to amounts on the order of 15 to 25% by weight of total composition. The use of such coupling or emulsifying agents as stabilizers can be burdensome both from a formulations standpoint and an economic standpoint. Thus, the normally inherent advantage of the liquid type detergent as regards ease of water dispersibility, particularly in cold water, vis-a-vis powdered or particulate detergents is somewhat offset by the limitations imposed on phosphate loading. Thus, increasing the phosphate content of liquid detergents substantially in excess of about 25% by weight invariably leads to phase separation and consequently, a product having little customer appeal.

Powdered detergents, though tolerating larger quantities of phosphate, suffer by comparison with liquid detergents with respect to water dispersibility. This is a particularly important consideration with respect to cold water washing.

A further disadvantage of the currently available powdered or liquid detergents is their limited effectiveness for use with washing machines provided with foraminous or open bucket type dispensers, this type of washing apparatus being particularly popular in European countries. With this type of washing machine, foraminous or open type buckets are attached to or integral with the machine and are positioned to communicate with the washing medium. The machine is equipped with suitable means enabling the programmed, incremental or delayed introduction of the contents of the buckets into the washing medium as by tipping, flooding, etc. In this manner, detergent, bleach, softener and the like are added to the washing medium automatically according to a predetermined schedule impressed upon the machine by the operator. Thus, liquid detergents often prematurely spill into the washing medium in significant amounts which may be due to the turbulence created by machine vibration while powdered detergents are apt to become clogged or caked due to the surrounding moist environment and thus difficult to discharge completely and efficiently from the bucket type container.

It is thus a primary object of the invention to provide detergent composition in stable gel form wherein the foregoing and related disadvantages are eliminated or at least mitigated to a substantial extent.

Another object of the invention is to provide detergent compositions in gel form capable of tolerating significant quantities of phosphate builder.

Still another object of the invention is to provide detergent compositions in gel form forming translucent, stable, single phase compositions having little or no tendency to "bleed" or otherwise phase separate despite prolonged periods of standing.

Yet another object of the invention is to provide gel type detergent compositions advantageously adapted for use with washing apparatus equipped with foraminous or open type bucket dispensers.

A further object of the invention is to provide gel type detergent composition wherein any necessity for use of coupling or emulsifying agents such as hydrotropes and organic polymeric resinous materials is eliminated.

A still further object of the invention is to provide a gel type detergent composition readily dispersible in aqueous media over a wide range of temperature having excellent detergency and especially with respect to particulate soil stains.

Yet a further object of the invention is to provide a gel type detergent composition which is essentially self supporting and may be readily and conveniently dispensed from a variety of carriers such as a tube, with practically no problem of spillage.

Other objects and advantages of the invention will become apparent hereinafter as the description proceeds.

BRIEF DESCRIPTION OF THE INVENTION

The foregoing objects are attained in accordance with the invention which in its broader aspects provides a highly concentrated detergent composition in the form of a stable, single phase, homogeneous gel comprising, by weight, (a) from about 5 to 40 parts of a sulfated, polyoxyalkylenated $C_{10}$ to $C_{22}$ alcohol containing from about 1 to 6 moles of combined alkylene oxide, the ratio of the number of carbon atoms in said alcohol to the number of moles of combined alkylene oxide being from about 2:1 to 5:1, (b) from about 25 to 55 parts of alkali metal pyrophosphate and (c) from about 30 to 50 parts of solvent medium comprising water and water miscible alcoholic solvent, the total of parts (a), (b) and (c) being 100 parts.

DETAILED DESCRIPTION OF THE INVENTION

The sulfated, polyoxyalkylenated alcohols useful herein in accordance with preferred embodiments are derived from $C_{10}$–$C_{22}$ monoalkanols which may be straight or branch-chained. Such compounds are known in the art as well as methods for their preparation. These compounds are usually provided in the form of the alkali metal salt, preferably the sodium or potassium salt and most preferably, the sodium salt. Other suitable water solubilizing cations include alkaline earth metals, ammonium, alkylamine and alkanolamine, the alkyl moiety preferably being of 1 to 4 carbon atoms. Particularly useful anionic detergents of the aforedescribed type are the Neodols available commercially from the Shell Chemical Company, such as the sulfate salts of the product obtained by reacting a $C_{12}$–$C_{15}$ alcohol with 3 moles of ethylene oxide, this particular product being commercially available under the trade name designation NEODOL 25-3S. Supplied commercially, the product contains about 60% anionic material, about 26% water and about 14% ethanol.

The preferred anionic detergent materials are derivatized with ethylene oxide in the amounts described. Other alkylene oxide such as propylene oxide may be used, however, ethylene oxide preferably comprises at least about 50% of the combined alkylene oxide units.

The other essential active ingredient of the instant gel detergent compositions is potassium pyrophosphate. Particularly preferred for use herein is potassium pyrophosphate provided as an aqueous solution. Other phosphates as well as other builders may be used in admixture with the pyrophosphate and in accordance with preferred practice the potassium pyrophosphate should comprise at least about 50% by weight of any phosphate mixture employed. These phosphate materials are well known as builder components of a wide variety of heavy duty type detergent compositions, and include sodium tripolyphosphate, sodium metaphosphate, sodium orthophosphate, etc. Other builders include silicates (e.g. sodium silicate, $Na_2O:SiO_2$ ratio from 1:1 to 1:3.5) carbonates, bicarbonates, borates, preferably as alkali metal salts as illustrative of inorganic builders and organic builders such as the alkali metal salts of aminopolycarboxylic acids (e.g., EDTA, NTA, DEPTA, hydroxyethyliminodiacetic) ethane hydroxyphosphonic, amino phosphonic, polyelectrolytes such as copolymers of ethylene and methyl vinyl ether, with maleic anhydride, polyacrylates, phylates, alkenylsuccinates, and the like.

The solvent used in forming the instant gel detergent compositions preferably comprises a mixture of water and water miscible, alcoholic solvent such as the lower alkanols of 1 to 4 carbon atoms, e.g., ethanol, n-propanol, isopropanol, and the like. Generally, water will comprise the majority of the solvent mixture with a weight ratio of water to alcohol of from about 5:1 to 20:1 being recommended.

In order to obtain a detergent gel product having the beneficial characteristics made possible by the present invention and particularly as regards stability and water dispersibility, the aforedescribed ingredients should be employed within certain mutual proportions. Thus, the sulfated, polyoxyalkylenated alcohol should comprise from about 5 to 40% of the composition with a range of 17 to 35% being preferred. On the other hand, the phosphate builder component should comprise from about 25 to 55% of the composition with a range of 30 to 45% being preferred. The weight ratio of phosphate to anionic is maintained within the range of from about 3.3:1 to 1:6 with a range of 2.7:1 to 1:1.2 preferred. This represents a particularly significant advantage of the invention. Previously, with non-solid detergent compositions, the maximum amount of phosphate tolerated in the detergent formula was on the order of about 15 to 25% and this despite the use of coupling and/or emulsifying agents is previously described. Increased amounts of phosphate, despite correlative increases in the amount of phase stabilizing ingredients invariably led to phase separation. By way of contrast, selection of ingredients described herein within the concentration ranges given not only enables the use of significantly increased amounts of phosphate but in addition, completely obviates any necessity for the use of couplers and/or emulsifiers to achieve a stable, single phase form of the detergent composition.

The solvent requirements will usually be satisfied by the anionic and phosphate ingredients, i.e., the phosphate and anionic materials as supplied usually contain in combination sufficient alcohol and water (the alcohol being obtained from the sulfated anionic detergent) to meet the solvent requirements. In any event, if necessary, the water and alcohol may be separately added.

The gel detergent compositions described herein may be prepared by mixing the sulfated, polyoxyalkylenated alcohol, phosphate and solvent ingredients with continued stirring or agitation being supplied. Initially, a composition having two well defined phases forms. However, with continued stirring, the two phase composition is transformed into a moderately viscous, translucent gel having good stability, there being no evidence of "bleeding" or other form of phase separation despite prolonged standing. The gel has a viscosity of from about 4,000 to 200,000 centipoises (cps) units and varies from a consistency which is pourable to one that is essentially self-supporting.

The gel form renders the instant detergent compositions advantageous for a wide variety of uses. Thus, contrary to liquid detergents, spillage is no problem. In addition, the gel composition can be packaged in a tube, for example, for easy dispensing by the user. Thus, the gel can be easily and conveniently hand carried making them exceptionally useful when travelling, camping, etc. A further advantage is their exceptional utility with washing machines equipped with foraminous or open bucket type dispensers. Since the gel is essentially form retaining, it is clearly advantageous over liquid type detergents. Moreover, since the gel comprises a viscous fluid, the clogging and caking problems encountered with powdered or particulate detergents are non-existent. Thus, the gel form partakes of the advantageous characteristics of both the liquid and solid detergents, i.e., the superior water dispersing characteristics of the liquids and the form retaining as well as phosphate accommodating characteristics of the solid detergents.

The gel detergent is highly concentrated and thus relatively small amounts can be used for normal washing. Thus, excellent detergency is obtained by using sufficient of the gel to provide a concentration of active ingredients in the aqueous washing medium of from about 0.5 to 5 g per liter and preferably about 1 g to 3 g per liter. The concentrated nature of the instant gels is evidenced by reference to the fact that 70 grams of the gel occupy about 60 milliliters and are equivalent in detergency performance to one and one quarter (1¼) cups of powdered detergent of standard commercial type. Moreover, the instant gels are markedly superior to equivalent amounts of unbuilt liquid laundry detergents and especially on particulate soils.

The excellent water dispersibility of the instant gels extends over a wide range of water temperatures and water hardness. Thus, effective detergency obtains using water temperatures ranging from 20° to 100° C., with a range of 30°–70° C. being preferred. Water hardness has little or no effect on detergency as evidenced by tests carried out in water having hardness (calculated as calcium carbonate) of from 0–50 ppm (soft water) to 300 ppm (hard water).

Small amounts of optional additives may be included in the aforedescribed compositions including, for example, filler salts, solvents, soil suspending agents, e.g., sodium carboxymethyl cellulose and polyvinyl alcohol, perfumes, dyes, optical brighteners, anti-oxidants, preservatives, bactericides, bleaches, bluing agents, germicides and the like. Generally, the concentration of a given ingredient will not exceed about 10% the combined concentrations of all such ingredients not exceeding about 20%.

Minor amounts of other supplemental organic detergents may be added if desired in amounts up to about 10% by weight of total composition. Such detergent may be of the anionic, nonionic and/or cationic type.

The anionic surface active agents include those surface active or detergent compounds which contain an organic hydrophobic group and an anionic, solubilizing group. Typical examples of anionic solubilizing groups are sulfonate, sulfate, carboxylate, phosphonate and phosphate. Examples of suitable anionic detergents which fall within the scope of the invention include the soaps, such as the water-soluble salts of higher fatty acids or rosin acids, such as may be derived from fats, oils and waxes of animal, vegetable origin, e.g., the sodium soaps of tallow, grease, coconut oil, tall oil and mixtures thereof; and the sulfated and sulfonated synthetic detergents, particularly those having about 8 to 26, and preferably about 12 to 22, carbon atoms to the molecule.

As examples of suitable synthetic anionic detergents there may be cited the higher alkyl mononuclear aromatic sulfonates such as the higher alkyl benzene sulfonates containing from 10 to 16 carbon atoms in the alkyl group in a straight or branched chain, e.g., the sodium salts of higher alkyl benzene sulfonates or of the higher alkyl toluene, xylene and phenol sulfonates; alkyl naphthalene sulfonate, ammonium diamyl naphthalene sulfonate, and sodium dinonyl naphthalene sulfonate. In one preferred type of composition there is used a linear alkyl benzene sulfonate having a high content of 3- ( or higher) phenyl isomers and a correspondingly low content (well below 50%) of 2- (or lower) phenyl isomers; in other terminology, the benzene ring is preferably attached in large part at the 3 or higher (e.g. 4,5,6 or 7) position of the alkyl group and the content of isomers in which the benzene ring is attached at the 2 or 1 position is correspondingly low. Particularly preferred materials are set forth in U.S. Pat. No. 3,320,174, May 16, 1967, of J. Rubinfeld.

Other anionic detergents are the olefin sulfonates, including long chain alkene sulfonates, long chain hydroxyalkane sulfonates or mixtures of alkenesulfonates, and hydroxyalkanesulfonates. These olefin sulfonate detergents may be prepared, in known manner, by the reaction of $SO_3$ with long chain olefins (of 8–25, preferably 12–21 carbon atoms) of the formula $RCH{=}CHR_1$, where R is alkyl and $R_1$ is alkyl or hydrogen, to produce a mixture of sultones and alkenesulfonic acids, which mixture is then treated to convert the sultones to sulfonates. Examples of other sulfate or sulfonate detergents are paraffin sulfonates, such as the reaction products of alpha olefins and bisulfites (e.g. sodium bisulfite), e.g., primary paraffin sulfonates of about 10–20, preferably about 15–20, carbon atoms; sulfates of higher alcohols; salts of $\alpha$-sulfofatty esters (e.g. of about 10- to 20-carbon atoms, such as metyl $\alpha$-sulfomyristate or $\alpha$-sulfotallowate).

Examples of sulfates of higher alcohols are sodium lauryl sulfate, sodium tallow alcohol sulfate. Turkey Red Oil or other sulfated oils, or sulfates of mono- or diglycerides of fatty acids (e.g. stearic monoglyceride monosulfate) alkyl poly (ethenoxy) ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly (ethenoxy) ether sulfates such as the sulfates of the condensation products of ethylene oxide and nonyl phenol (usually having 1 to 6 oxyethylene groups per molecule).

The suitable anionic detergents include also the acyl sarcosinates (e.g. sodium lauroylsarcosinate), the acyl esters (e.g. oleic acid ester) of isethionates, and the acyl N-methyl taurides (e.g. potassium N-methyl lauroyl- or oleyl tauride).

The most highly preferred water-soluble anionic detergent compounds are the ammonium and substituted ammonium (such as mono-, di- and triethanolamine), alkali metal (such as sodium and potassium) and alkaline earth metal (such as calcium and magnesium) salts of the higher alkyl benzene sulfonates, olefin sulfonates, the higher alkyl sulfates, and the higher fatty acid monoglyceride sulfates. The particular salt will be suitably selected depending upon the particular formulation and the proportions therein.

Nonionic surface active agents include those surface active or detergent compounds which contain an organic hydrophobic group and a hydrophilic group which is a reaction product of a solubilizing group such as carboxylate, hydroxyl, amido or amino with ethylene oxide or with the polyhydration product thereof, polyethylene glycol.

As examples of nonionic surface active agents which may be used there may be noted the condensation products of alkyl phenols with ethylene oxide, e.g., the reaction product of isooctyl phenol with about 6 to 30 ethylene oxide units; condensation products of alkyl thiophenols with 10 to 15 ethylene oxide units; condensation products of higher fatty alcohols such as tridecyl alcohol with ethylene oxide; ethylene oxide addends of mono-esters of hexahydric alcohols and inner ethers thereof such as sorbitan monolaurate, sorbitol monooleate and mannitan monopalmitate, and the condensation products of polypropylene glycol with ethylene oxide.

Cationic surface active agents may also be employed. Such agents are those surface active detergent compounds which contain an organic hydrophobic group and a cationic solubilizing group. Typical cationic solubilizing groups are amine and quaternary groups.

As examples of suitable synthetic cationic detergents there may be noted the diamines such as those of the type $RNHC_2H_4NH_2$ wherein R is an alkyl group of about 12 to 22 carbon atoms, such as N-2-aminoethyl stearyl amine and N-2-aminoethyl myristyl amine; amide-linked amines such as those of the type $R^1CONHC_2H_4NH_2$ wherein $R^1$ is an alkyl group of about 9 to 20 carbon atoms, such as N-2-amino-ethyl stearyl amide and N-aminoethyl myristyl amide; quaternary ammonium compounds wherein typically one of the groups linked to the nitrogen atom is an alkyl group of about 12 to 18 carbon atoms and three of the groups linked to the nitrogen atom are alkyl groups which contain 1 to 3 carbon atoms, including such 1 to 3 carbon alkyl groups bearing inert substituents, such as phenyl groups, and there is present an anion such as halogen, acetate, methosulfate, etc. Typical quaternary ammonium detergents are ethyl-dimethyl-stearyl ammonium chloride, benzyl-dimethyl-stearyl ammonium chloride, benzyl-dimethyl-stearyl ammonium chloride, trimethyl stearyl ammonium chloride, trimethyl-cetyl ammonium bromide, dimethylethyl dilauryl ammonium chloride, dimethyl-propyl-myristyl ammonium chloride, and the corresponding methosulfates and acetates.

Examples of suitable amphoteric detergents are those containing both an anionic and a cationic group and a hydrophobic organic group, which is advantageously a higher aliphatic radical, e.g., of 10–20 carbon atoms. Among these are the N-long chain alkyl aminocarboxylic acids $$\text{(e.g. of the formula } R-\overset{\overset{R_2}{|}}{N}-R'-COOM)$$

the N-long chain alkyl iminodicarboxylic acids $$\text{(e.g. of the formula } RN(R'COOM)_2)$$

and the N-long chain alkyl betaines $$\text{(e.g. of the formula } R-\overset{\overset{+R_3}{|}}{\underset{\underset{R_4}{|}}{N}}-R'-COO^-)$$

where R is a long chain alkyl group, e.g. of about 10–20 carbons, R′ is a divalent radical joining the amino and carboxyl portions of an amino acid (e.g. an alkylene radical of 1–4 carbon atoms), M is hydrogen or a salt-forming metal, $R_2$ is a hydrogen or another monovalent substituent (e.g. methyl or other lower alkyl), and $R_3$ and $R_4$ are monovalent substituents joined to the nitrogen by carbon-to-nitrogen bonds (e.g. methyl or other lower alkyl substituents). Examples of specific amphoteric detergents are N-alkyl-beta-aminopropionic acid; N-alkyl-beta-iminodipropionic acid, and N-alkyl, N,N-dimethyl glycine; the alkyl group may be, for example, that derived from coco fatty alcohol, lauryl alcohol, myristyl alcohol (or a lauryl-myristyl mixture) hydrogenated tallow alcohol, cetyl, stearyl, or blends of such alcohols. The substituted aminopropionic and iminodipropionic acids are often supplied in the sodium or other salt forms, which may likewise be used in the practice of this invention. Examples of other amphoteric detergents are the fatty imidazolines such as those made by reacting a long chain fatty acid (e.g. of 10 to 20 carbon atoms) with diethylene triamine and monohalocarboxylic acids having 2 to 6 carbon atoms, e.g. 1-coco-5-hydroxyethyl-5-carboxymethyl-imidazoline; betaines containing a sulfonic group instead of the carboxylic group; betaines in which the long chain substituent is joined to the carboxylic group without an intervening nitrogen atom, e.g., inner salts of 2-trimethylamino fatty acids such as 2-trimethylaminolauric acid, and compounds of any of the previously mentioned types but in which the nitrogen atom is replaced by phosphorus.

The invention is illustrated in the following examples which are not to be considered as being limitative. All parts and percentages are by weight unless otherwise indicated.

EXAMPLE 1

A gel detergent is prepared from the following composition:

| INGREDIENT | % ACTIVE |
|---|---|
| *$C_{10}$–$C_{15}$ alcohol-3 moles ethylene oxide sulfate, Na salt | 17.1 |
| Potassium pyrophosphate | 42.9 |
| Ethanol (from alcohol EO sulfate) | 4.0 |
| Water (from alcohol EO sulfate and phosphate) | 36.0 |

*NEODOL 25-3S 60% active ingredient, 26% water, 14% ethanol available from Shell Chemical Co.

the ingredients are mixed with constant stirring being applied. Initially, a two phase mixture forms, however, with continued stirring a moderately viscous, translucent gel forms. After standing for two weeks, there is no evidence of "bleeding" or other form of phase separation. Viscosity is 9600 centipoises at 76° F.

The composition is added to an aqueous washing medium in an automatic washing machine containing garments soiled with particulate soil stain. Washing is carried out at about 70° C. and a concentration of gel detergent of 1 gram per liter. Excellent detergency is obtained as indicated by reflectometer tests taken before and after washing of the garments.

EXAMPLE 2

Example 1 is repeated. In this case, washing is carried out at a temperature of 20°. Again, excellent detergency is obtained.

EXAMPLES 3–5

Detergents are prepared from the following compositions:

| Ingredient | % | | |
|---|---|---|---|
| | Example 3 | Example 4 | Example 5 |
| $C_{12-15}$ alcohol-3 moles ethylene oxide sulfate, Na salt | 12.0 | 24.0 | 30.0 |
| Potassium Pyrophosphate | 48.0 | 36.0 | 30.0 |
| Ethanol (from alcohol EO sulfate) | 2.8 | 5.6 | 7.0 |
| Water (from alcohol EO sulfate and phosphate) | 37.2 | 34.4 | 33.0 |

After stirring, Example 3 separated very rapidly into 2 layers—about 75% clear bottom layer and 25% opaque, viscous top layer. Upon vigorous shaking after standing overnight, a uniform stable, gel is produced.

Example 4 is a translucent pourable gel, exhibiting good stability, but after aging 24 hours, a trace of clear top layer separation is observed.

Example 5 is a pourable, viscous liquid with only a trace of clear top layer separation after 4 hours.

EXAMPLE 6

Example 4 is repeated except that 5% of the solvent is removed via evaporation on a steambath. The result is an essentially self-supporting gel with a viscosity of 22,000 cps at 76° F. and exhibiting excellent stability. The composition is the following:

| | % |
|---|---|
| $C_{12-15}$ alcohol-3 moles ethylene oxide sulfate, Na salt | 24.7 |
| Potassium pyrophosphate | 36.7 |
| Solvent | 38.6 |

EXAMPLE 7

Example 5 is repeated except that 10% of the solvent is removed via evaporation on a steambath. The result is a self-supporting gel with a viscosity of 85,000 cps at 76° F. and exhibiting excellent stability. The composition is the following:

| | |
|---|---|
| $C_{12-15}$ alcohol-3 moles ethylene oxide sulfate, Na salt | 31.3 |
| Potassium pyrophosphate | 31.3 |
| Solvent | 37.4 |

This example further illustrates the large effect of relatively small variations in solvent content on viscosity and stability.

EXAMPLE 8

Example 1 is repeated except that the NEODOL 25-3S is replaced by an equivalent amount of linear tridecyl benzene sulfonate. A single phase gel is not obtainable. Upon mixing the ingredients, there is immediate separation with the formation of a granular top player. Continued mixing with agitation is ineffective, the separate phases remaining.

EXAMPLE 9

Example 1 is repeated except that half of the NEODOL 25-3S is replaced by NEODOL 25-9, a nonionic material obtained by the condensation of a $C_{12}$–$C_{15}$ alcohol with 9 moles of ethylene oxide. A single phase composition is not obtainable.

EXAMPLE 10

Example 1 is repeated except that the active ingredients comprise

6% ether sulfate
54% potassium pyrophosphate
1.4% ethanol
38.6% water

Initially, a two-phase mixture forms which after standing overnight is transformed into a viscous homogeneous stable gel upon vigorous shaking.

As indicated in examples 8 and 9, relatively minor deviations from the limitations and parameters described herein lead to ineffective compositions, thereby pointing up the essential character of the sulfate, polyoxyalkylenated $C_{10}$–$C_{22}$ alcohol and pyrophosphate materials.

Results similar to those described in the preceeding examples are obtained when the procedures are repeated but adding minor amounts of supplemental detergent, bleach, bluing agent, brightener, germicide, anticorrosion agent, etc. of the type hereinbefore described. However, the quantities of such ingredients must be maintained within the range given to avoid phase separation problems.

It is of course understood that where ingredients other than as critically specified herein are employed (e.g. supplemental detergent, adjuvants, etc.) the percent of each of the critical components (i.e., 5–40% ether sulfate 25–55% pyrophosphate and 30–50% solvent medium) will vary somewhat within the parameters of the additional components. Thus, for example, with 20% adjuvants and 10% supplemental detergent the % of ether sulfate will range from about 3 to 40%, the pyrophosphate from about 19 to 55% and the solvent medium from 23 to 50%.

The foregoing detailed description is given by way of illustration only. Thus, variations may be made therein without departing from the scope and spirit of the invention.

What is claimed is:

1. A concentrated detergent composition in the form of a translucent, stable, single phase gel comprising by weight (A) from about 5 to 40 parts of an anionic detergent comprising a, polyoxyalkylenated $C_{10}$–$C_{22}$ alcohol sulfate containing from about 1 to 6 moles of combined alkylene oxide, the ratio of the number of carbon atoms in said alcohol to the number of combined alkylene oxide being from about 2:1 to 5:1, (B) from about 25 to 55 parts of potassium pyrophosphate, and from about 30 to 50 parts of solvent medium comprising water and water miscible alcoholic solvent, (A), (B) and (C) totalling 100 parts.

2. A composition according to claim 1 wherein said anionic detergent contains about 3 moles of combined ethylene oxide.

3. A composition according to claim 1 wherein said alcohol is a $C_{12}$–$C_{15}$.

4. A composition according to claim 1 wherein said water miscible alcoholic solvent is ethanol.

5. A composition according to claim 1 containing up to 10% of supplemental organic detergent selected from the group consisting of water soluble anionic, nonionic, cationic and amphoteric detergent.

6. A composition according to claim 1 wherein said gel has a viscosity of from about 4000 to 200,000 cps.

7. A composition according to claim 1 wherein said anionic detergent is the sodium sulfate salt of a $C_{12}$–$C_{15}$ alcohol containing 3 moles of combined ethylene oxide.

8. A composition according to claim 1 wherein the weight ratio of water to water-miscible alcoholic solvent is from about 5:1 to 20:1.

9. A composition according to claim 8 wherein the weight ratio of pyrophosphate to anionic detergent is about 3.3:1 to 1:6.

10. A composition according to claim 9 wherein the weight ratio of pyrophosphate anionic detergent is about 2.7:1 to 1.1:2.

11. A method for washing soiled garments which comprises contacting said garments in an aqueous medium at a temperature of from about 20° C. to 100° C. with from 0.5 to 5 grams per liter of the composition of claim 1.

* * * * *